US007832337B2

(12) United States Patent
Stock, Jr.

(10) Patent No.: US 7,832,337 B2
(45) Date of Patent: Nov. 16, 2010

(54) SHELLCASE FOR CONTROLLING REFLECTIONS OF PRIMER SHOCKWAVES

(75) Inventor: Michael Eugene Stock, Jr., Maryville, IL (US)

(73) Assignee: Olin Corporation, East Alton, IL (US)

( * ) Notice: Subject to any disclaimer, the term of this patent is extended or adjusted under 35 U.S.C. 154(b) by 0 days.

(21) Appl. No.: 12/604,602

(22) Filed: Oct. 23, 2009

(65) Prior Publication Data

US 2010/0107916 A1 May 6, 2010

Related U.S. Application Data

(62) Division of application No. 10/980,107, filed on Nov. 1, 2004, now Pat. No. 7,607,392.

(51) Int. Cl.
*F42B 5/26* (2006.01)

(52) U.S. Cl. ..... 102/464; 102/430; 86/19.5

(58) Field of Classification Search ..... 102/464–472; 86/19.5

See application file for complete search history.

(56) References Cited

U.S. PATENT DOCUMENTS 5,353,779 A 10/1994 Lyon ..... 124/57
6,393,991 B1 5/2002 Funston et al. ..... 102/476
6,523,475 B2 2/2003 Smalley et al. ..... 102/430
6,832,556 B1 12/2004 Smalley, Jr. ..... 102/430
7,086,336 B2 8/2006 Smalley et al. ..... 102/430
2002/0121211 A1 9/2002 Smalley et al. ..... 102/430
2003/0079639 A1 5/2003 Smalley et al. ..... 102/430
2004/0237827 A1 12/2004 Smalley et al. ..... 102/430

*Primary Examiner*—Troy Chambers
(74) *Attorney, Agent, or Firm*—Harness, Dickey & Pierce, P.L.C.

(57) ABSTRACT

A shellcase body for use as part of an ammunition cartridge, which includes a base portion at one end, a middle portion having a substantially straight sidewall and joined with the base portion, and a shoulder portion joined to and extending from the middle portion. A neck portion may be joined to and extend from the shoulder portion. The shoulder portion is typically annularly shaped and includes a semi-circular sidewall that extends between an aft end and a fore end. The semi-circular sidewall has a curvature that is defined by a circular arc having a predetermined radius and a center that is positioned a distance away from the shellcase body center longitudinal axis. The shoulder portion is joined with the straight sidewall at a secant point of the circular arc, i.e., the straight sidewall defines a secant line that intersects the circular arc at the aforementioned secant point.

15 Claims, 7 Drawing Sheets

SHELLCASE FOR CONTROLLING REFLECTIONS OF PRIMER SHOCKWAVES

CROSS-REFERENCE TO RELATED APPLICATIONS

This is a divisional application of U.S. patent application Ser. No. 10/980,107, filed Nov. 1, 2004, which is now U.S. Pat. No. 7,607,392 which issued Oct. 27, 2009.

BACKGROUND OF THE INVENTION (1) Field of the Invention

The present invention generally relates to a shellcase body for use as part of an ammunition cartridge, which may be used with both rifles and pistols. In particular, the present invention is directed to a shellcase body and method for controlling the reflection of primer shockwaves.

(2) Description of the Related Art

Shellcase bodies typically have one of two general designs: straight and bottleneck. Bottleneck shellcase bodies include a shoulder portion that defines a bottleneck cross-section. Bottleneck shellcase bodies were developed to house larger amounts of propellants than their predecessor, the straight-walled shellcase. While bottleneck shellcases achieve the goal of greater propellant capacity, their internal geometry may cause problems with propellant ignition. Primer explosion shockwaves reflect off the shoulder to cause propellant throughout the shellcase to ignite. It is however possible that in an ill designed bottlenecked shellcase the shockwave reflections may be misguided and be detrimental to the overall performance level of the ammunition cartridge. A typical bottleneck design includes a frusto-conical portion disposed between a larger cylindrical portion containing propellant and a smaller cylindrical portion that contains a projectile.

Prior attempts have been made to define bottleneck shellcase shoulders with forms other than the most common frusto-conical section. However, previous designs have typically been limited by their own manufacturability and the availability of tools required to manufacture them. In addition, other previous designs typically fail to properly control the location of primer explosion shockwaves.

One previous design as disclosed in U.S. Pat. No. 6,523,475 includes a shoulder defined by an ellipse centered on the longitudinal axis of the shellcase. The ellipse foci are located at the origin of the primer explosion shockwave and just behind the base of the bullet. Unfortunately, this design suffers from multiple shortcomings. First, due to the modern state of computer-driven manufacturing operations, it is difficult to program shape cutting equipment with ellipsoidal shapes. Second, due to the internal nature of the elliptically defined shape, it will likely be difficult to ensure that shellcase manufacture will result in the desired ellipsoidal shape and not a slightly different ellipsoidal shape, which would counteract the anticipated performance gains. Third, the prior design does not appear to address how the ellipsoidal shellcase will headspace, i.e., fit, within a firearm chamber. Finally, the ellipsoidal shellcase of the prior design is designed to redirect the primer explosion shockwaves to a single point within the inner cavity of the shellcase. However, manufacturing tolerances inherent in common ammunition-manufacturing processes will make it difficult to achieve such precise redirection of the primer explosion shockwaves.

Referring now to FIG. 1, another previous design includes a shellcase body 20 having a straight sidewall 22 joined to a shoulder 24, which includes a curvature that is defined by a circular arc 26 having a center 28 that is positioned a distance D away from the longitudinal axis 30 of the shellcase. Straight sidewall 22 is joined to shoulder 24 at a tangent point 32 of circular arc 26, i.e., the straight sidewall defines a tangent line 34 that intersects the circular arc at the tangent point. Although the design of FIG. 1 is an improvement over previous designs, it too has shortcomings.

By joining straight sidewall 22 to shoulder 24 at tangent point 32, the curvature of the shoulder defined by circular arc 26 is too shallow. A shallow curvature causes primer explosion shockwaves 36, which originate at primer explosion 38, to reflect off shoulder 24 to an area 40 that extends into a neck portion 42 of shellcase body 20. Typically, neck portion 42 holds a projectile 44, which includes an aft end 46 that will likely be encroached by area 40. As a result, projectile 44 may become prematurely dislodged from the shellcase neck, i.e., before the propellant (not shown) contained in shellcase 20 is sufficiently ignited by the primer blast flame front and the concentration of the redirected primer explosion shockwaves 36.

BRIEF SUMMARY OF THE INVENTION

One aspect of the present invention is a shellcase body for use as part of an ammunition cartridge, which includes a base portion, a middle portion joined with the base portion, the base portion and the middle portion being arranged around a center longitudinal axis, and a shoulder portion having a curvature that is defined by a circle having a predetermined radius and a center that is positioned a distance away from the center longitudinal axis. In addition, the shoulder portion is joined with the middle portion at a secant point of the circle.

Another aspect of the present invention is a shellcase body for use as part of an ammunition cartridge, which includes an annular base portion having a center boring formed therethrough, a substantially cylindrical middle portion having a substantially straight sidewall including an aft end and a fore end, the aft end being joined with the annular base portion, the annular base portion and the substantially cylindrical middle portion being arranged around a center longitudinal axis, an annular shoulder portion having a semi-circular sidewall that extends between an aft end and a fore end, the semi-circular sidewall having a curvature that is defined by a circle having a predetermined radius and a center that is positioned a distance away from the center longitudinal axis, wherein the aft end is joined with the fore end of the substantially straight sidewall at a secant point of the circle, and a substantially cylindrical neck portion having a substantially straight sidewall including an aft end and a fore end, the aft end being joined with the fore end of the semi-circular sidewall.

Still another aspect of the present invention is an ammunition cartridge, which includes the following: a shellcase body having an annular base portion having a center boring formed therethrough, a substantially cylindrical middle portion having a substantially straight sidewall including an aft end and a fore end, the aft end being joined with the annular base portion, the annular base portion and the substantially cylindrical middle portion being arranged around a center longitudinal axis, the substantially cylindrical middle portion having an internal cavity in communication with the annular base portion, an annular shoulder portion having a semi-circular sidewall that extends between an aft end and a fore end, the semi-circular sidewall having a curvature that is defined by a circle having a predetermined radius and a center that is positioned a distance away from the center longitudinal axis, wherein the aft end is joined with the fore end of the substantially straight sidewall at a secant point of the circle, and a substantially cylindrical neck portion having a substantially straight sidewall including an aft end and a fore end, the aft end being joined with the fore end of the semi-circular sidewall, a primer positioned within the center boring of the annular base portion; a propellant positioned within the internal cavity of the substantially cylindrical middle portion; and a projectile having fore and aft portions, at least a portion of the projectile positioned in and retained by the substantially cylindrical neck portion, the aft portion positioned adjacent the aft end of the substantially cylindrical neck portion and the fore portion extending from the substantially cylindrical neck portion.

Yet another aspect of the present invention is a method of controlling shockwaves from an explosion of a primer in an ammunition cartridge including the following steps: forming a shellcase having a center longitudinal axis and including both a substantially straight sidewall and a semi-circular sidewall having a curvature that is defined by a circle having a predetermined radius and a center that is positioned a distance away from of the center longitudinal axis, wherein the semi-circular sidewall is joined with the substantially straight sidewall at a secant point of the circle; and directing the primer explosion shockwaves at the semi-circular sidewall.

Still another aspect of the present invention is a system for controlling shockwaves from an explosion of a primer in an ammunition cartridge, which includes a mechanism for forming a shellcase having a center longitudinal axis and including both a substantially straight sidewall and a semi-circular sidewall having a curvature that is defined by a circle having a predetermined radius and a center that is positioned a distance away from the center longitudinal axis, wherein the semi-circular sidewall is joined with the substantially straight sidewall at a secant point of the circle, and a mechanism for directing the primer explosion shockwaves at the semi-circular sidewall.

Yet another aspect of the present invention is a method of determining the location of primer shockwaves along a center longitudinal axis in a shellcase body of a center-fire ammunition cartridge, the primer shockwaves being redirected by a semi-circular sidewall of the shellcase body, the semi-circular sidewall having a curvature that is defined by a circle having a predetermined radius and a center that is positioned a distance away from the center longitudinal axis and the semi-circular sidewall being joined with a remaining portion of the shellcase body at a secant point of the circle. The method includes the following steps: (a) solving $\chi_h=\sqrt{r^2-(y_k-k)^2}+h$, wherein r is a radius of the circle defining the curvature of the semi-circular sidewall, $y_k$ is the y-coordinate of a point on the semi-circular sidewall, k is the y-coordinate of the center of the circle, and h is the x-coordinate of the center of the circle; (b) solving $$\Phi = \tan^{-1}\left(\frac{y_k - k}{x_h - h}\right),$$

wherein $y_k$ is the y-coordinate of a point on the semi-circular sidewall, k is the y-coordinate of the center of the circle, h is the x-coordinate of the center of the, and $x_h$ is the x-coordinate of a point on the semi-circular sidewall that was solved for in step (a); (c) solving $$\gamma = \tan^{-1}\left(\frac{y_k}{x_h}\right),$$

wherein $y_k$ is the y-coordinate coordinate of a point on the semi-circular sidewall and $x_h$ is the x-coordinate of a point on the semi-circular sidewall that was solved for in step (a); (d) solving $\theta=\Phi-\gamma$=result of step (b)−result of step (c); (e) solving $$\Xi = \frac{y_k}{\tan^{-1}(\pi - \theta + \Phi)},$$

wherein $y_k$ is the y-coordinate of a point on the semi-circular sidewall, $\theta$ is the result of step (d), and $\Phi$ is the result of step (b); and (f) solving $\chi_2=\chi_h+\Xi$, wherein $x_h$ is the x-coordinate of a point on the semi-circular sidewall that was solved for in step (a), $\Xi$ is the result of step (e), and $x_2$ is the x-coordinate of the position of a primer shockwave along the center longitudinal axis.

Still another aspect of the present invention is a method of determining the location of redirected primer shockwaves along a center longitudinal axis in a shellcase body of a rim-fire ammunition cartridge, the primer shockwaves being redirected by a semi-circular sidewall of the shellcase body, the semi-circular sidewall having a curvature that is defined by a circle having a predetermined radius and a center that is positioned a distance away from the center longitudinal axis and the semi-circular sidewall being joined with a remaining portion of the shellcase body at a secant point of the circle. The method includes the following steps: (a) solving $\chi_h=\sqrt{r^2-(y_k-k)^2}+h$, wherein r is a radius of the circle defining the curvature of the semi-circular sidewall, $y_k$ is the y-coordinate of a point on the semi-circular sidewall, k is the y-coordinate of the center of the circle, and h is the x-coordinate of the center of the circle; (b) solving $$\Phi = \tan^{-1}\left(\frac{y_k - k}{x_h - h}\right),$$

wherein $y_k$ is the y-coordinate of a point on the semi-circular sidewall, k is the y-coordinate of the center of the circle, h is the x-coordinate of the center of the circle, and $x_h$ is the x-coordinate of a point on the semi-circular sidewall that was solved for in step (a); (c) solving $\Psi=\sqrt{\chi_h^2-(\Sigma-y_k)^2+y_k^2}$, wherein $x_h$ is the x-coordinate of a point on the semi-circular sidewall that was solved for in step (a), $\Sigma$ is the y-coordinate of the blast origin for a rimfire design, and $y_k$ is the y-coordinate of a point on the semi-circular sidewall; (d) solving $$Z = \cos^{-1}\left(\frac{\Psi - \chi_h^2 - (\Sigma - y_k)^2 + y_k^2}{2y_k\left(\sqrt{\chi_h^2 + (\Sigma - y_k)^2}\right)}\right),$$

wherein $\Psi$ is the length of a line extending from the blast origin $(0, \Sigma)$ to the center longitudinal axis, $\chi_h$ is the x-coordinate of a point on the semi-circular sidewall point that was solved for in step (a), $\Sigma$ is the y-coordinate of the blast origin for a rimfire design, and $y_k$ is the y-coordinate of a point on the semi-circular sidewall; (e) solving $$\beta = \tan^{-1}\left(\frac{y_k + k}{x_h - h}\right),$$

wherein $y_k$ is the y-coordinate of a point on the semi-circular sidewall, k is the y-coordinate of the center of the circle, $x_h$ is the x-coordinate of a point on the semi-circular sidewall that was solved for in step (a), and h is the x-coordinate of the center of the circle; (f) solving $\theta = Z - \beta$, wherein Z is result of step (d) and $\beta$ is the result of step (g); (g) solving $$\Xi = \frac{y_k}{\tan^{-1}(\pi - \theta + \Phi)},$$

wherein $y_k$ is the y-coordinate of a point on the semi-circular sidewall, $\theta$ is the result of step (d), and $\Phi$ is the result of step (b); and (h) solving $\chi_2 = \chi_h + \Xi$, wherein $x_h$ is the x-coordinate of a point on the semi-circular sidewall that was solved for in step (a), $\Xi$ is the result of step (e), and $x_2$ is the x-coordinate of the position of a primer shockwave along the center longitudinal axis.

BRIEF DESCRIPTION OF THE DRAWINGS

For the purpose of illustrating the invention, the drawings show a form of the invention that is presently preferred. However, it should be understood that the present invention is not limited to the precise arrangements and instrumentalities shown in the drawings, wherein.

DETAILED DESCRIPTION

The shellcases of the present invention are designed to minimize both the ratio of surface area to volume of the shellcase's internal cavity, i.e., where propellant is housed, and the length of the powder column or propellant. This is done to limit the possible sites for heat transfer from the burning propellant to the shellcase, and thus the rifle chamber itself. This heat transfer serves to slow the burning rate of the propellant and in some instances stop it altogether. In addition, the shellcases of the present invention are also designed to redirect a large concentration of the primer blast shockwaves to an area just behind the aft end of the projectile. These design criteria are achieved through mathematical computations, but are bounded by the geometric constraints of modern firearms and driven by the available propellants. Typically, a cartridge design is based upon a desired internal volume required to house the propellant. A volume is chosen to house the necessary charge weight to propel the projectile at the desired velocity within acceptable pressure limits. First, for a desired internal volume, an optimum cavity can be attained which will limit the surface area to volume (SA/V) ratio as defined by the following equation (1), with r being the radius of the shellcase internal cavity and h being the length of the shellcase internal cavity if it were simply cylindrically shaped:

$$\frac{SA}{V} = \frac{2\pi r^2 h + 2\pi r h}{\pi r^2 h} = \frac{2(r+h)}{rh} = \frac{2r + \frac{2V}{\pi r^2}}{\frac{rV}{\pi r^2}} \tag{1}$$

The ratio represented by equation (1) is minimized when the cylinder diameter, i.e., twice the radius, or internal diameter of the shellcase body is equal to that of its height. Such a design yields an SA/V ratio that is less than that of conventional shellcases, e.g., as much as 25% for some like-volumed shellcases. However, the internal diameter of the shellcase body may be bounded by the size constraints of modern arms. Larger shellcases have larger volumes and thus larger diameters. Although the larger diameter shellcases will perform as designed, the diameter often surpasses the common chamber diameters in today's firearms. To reduce the diameter (from the optimum diameter to one that will fit in an existing chamber) while maintaining an improved SA/V ratio, the shellcase length must be increased. However, with proper shoulder orientation, shellcases may still be designed with less than optimum diameters while achieving gains in the SA/V ratio versus conventional cartridges of the same volume.

Figure 1:
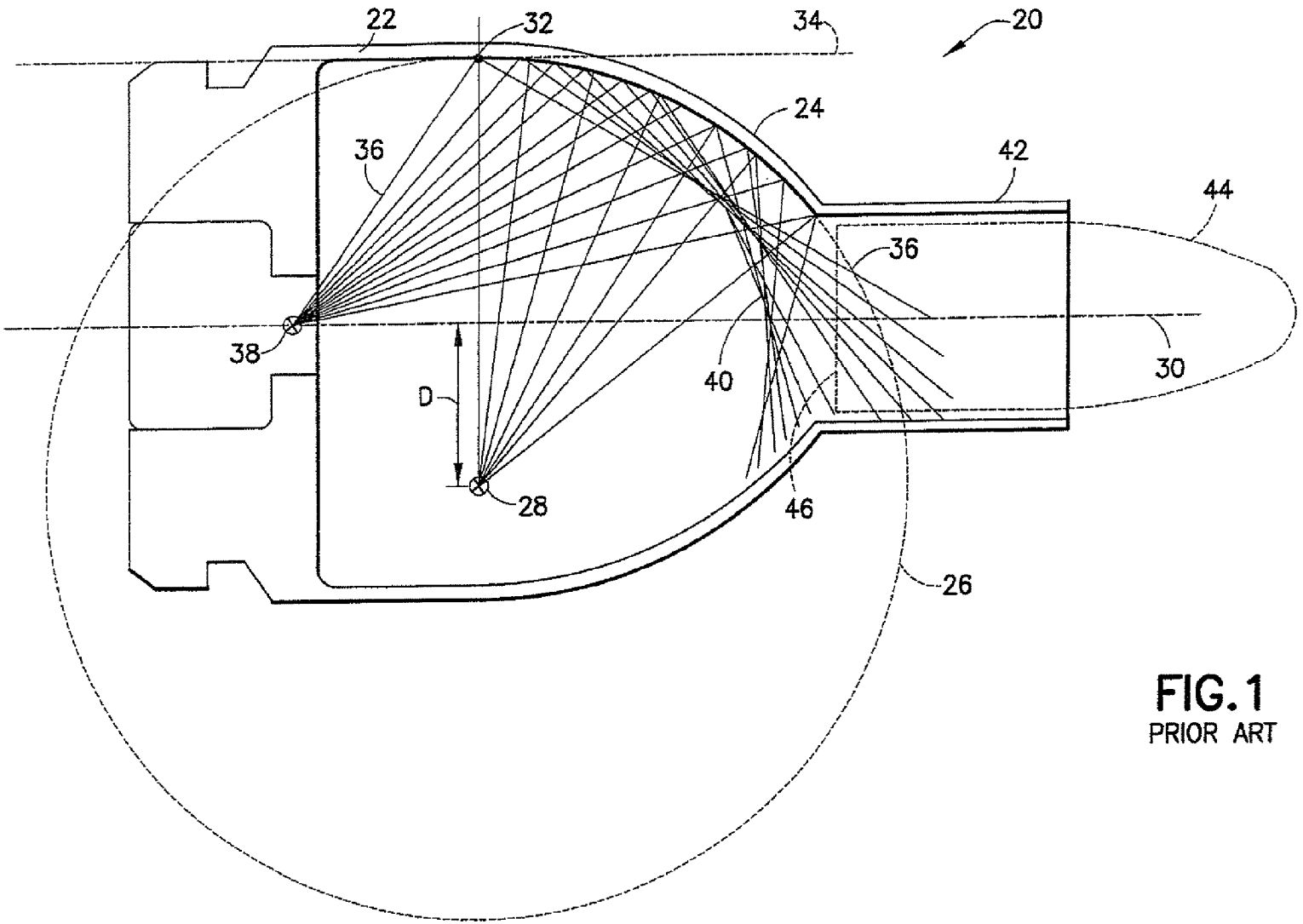
FIG. 1 PRIOR ART
FIG. 1 is a cross-section of a prior art shellcase body.
Figure 2:
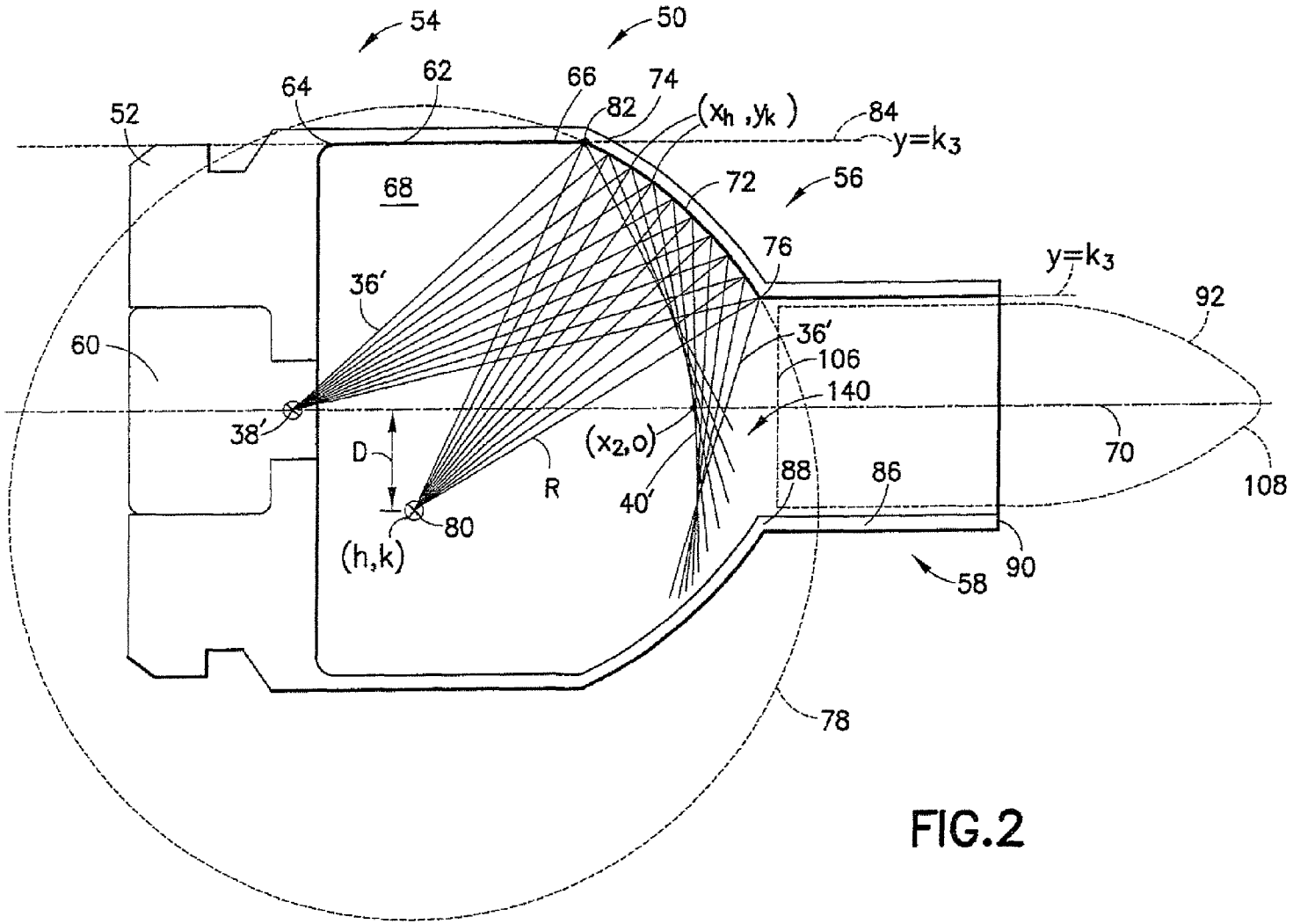
FIG. 2 is a cross-section of a shellcase body according to one embodiment of the present invention.

Referring now to the drawings in which like reference numerals indicate like parts, and in particular to FIG. 2, one aspect of the present invention is a shellcase body 50 for use as part of an ammunition cartridge, which includes a base portion 52 at one end, a middle portion 54, joined with said base portion, and a shoulder portion 56 joined to and extending from said middle portion. In some embodiments, a neck portion 58 is joined to and extends from shoulder portion 56.

Base portion 52 is typically annularly or disk shaped and includes an annular center boring 60. Center boring 60 is typically sized to hold a primer of a predetermined size (not shown). This primer generally contains a priming mix and anvil (not shown). In general, base portion 52 is similar to base portions found in typical ammunition cartridges.

Figure 3:
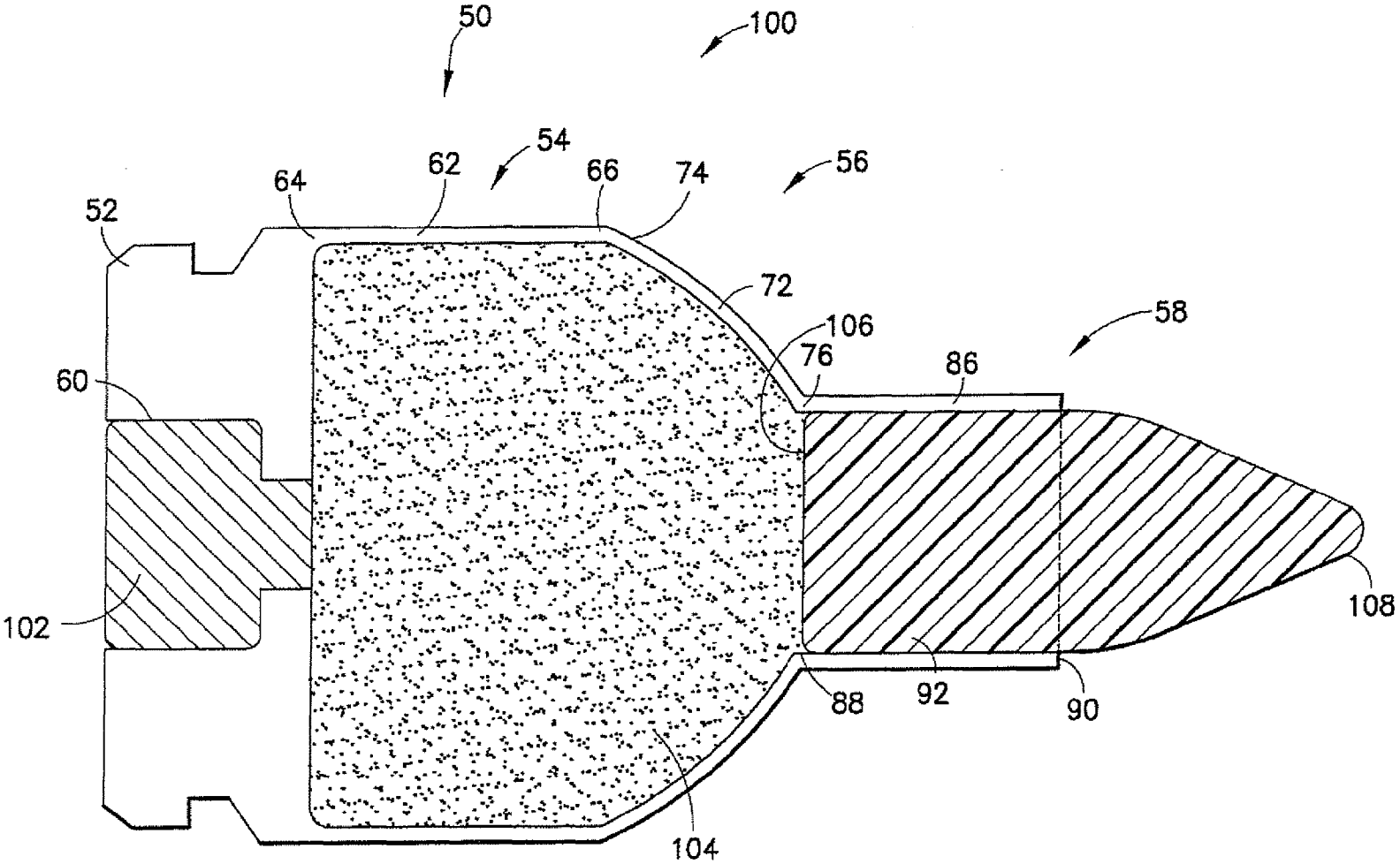
FIG. 3 is a cross-section of an ammunition cartridge according to one embodiment of the present invention.

Middle portion 54 is typically substantially cylindrically shaped and includes a substantially straight sidewall 62 formed between an aft end 64 and a fore end 66. As one skilled in the art will appreciate, shellcase body 50 is sized so that some draft or space exists between the chamber walls and the body to facilitate removal of the body from the chamber after firing. Regarding substantially straight sidewall 62, in at least one embodiment, the sidewall is thicker near aft end 64 and tapers to a thinner dimension as it approached fore end 66. As used herein the term "substantially straight" refers to both parallel and slightly skewed sidewalls of uniform and non-uniform thicknesses. Aft end 64 is joined to base portion 52. An internal cavity 68 is defined within middle portion 54 and is in communication with center boring 60. Middle portion 54 and internal cavity 68 in particular are sized to hold a predetermined amount of a propellant (as illustrated in FIG. 3). Middle portion 54 and base portion 52 are typically arranged symmetrically around a center longitudinal axis 70.

Shoulder portion 56 is typically annularly shaped and includes a semi-circular sidewall 72 that extends between an aft end 74 and a fore end 76. Semi-circular sidewall 72 has a curvature that is defined by a circular arc 78 having a predetermined radius R and a center 80 that is positioned a distance D away from center longitudinal axis 70. Aft end 74 of shoulder portion 56 is joined with fore end 66 of straight sidewall 62 at a secant point 82 of circular arc 78, i.e., the straight sidewall defines a secant line 84 that intersects circular arc 78 at the secant point.

Neck portion 58 is typically substantially cylindrically shaped and includes a substantially straight sidewall 86 having an aft end 88 and a fore end 90. Aft end 88 is joined with shoulder portion 56 at an end opposite secant point 82, i.e., fore end 76 of semi-circular sidewall 72. Neck portion 58 is typically sized to encircle a projectile 92 (shown in dashed lines) having a predetermined caliber.

The redirection of the primer explosion shockwaves 36' via shoulder portion 56 may be tuned using the following equations to arrive at a design that concentrates the majority of the reflected shockwaves in a desired location:

$$\chi_h = \sqrt{r^2 - (y_k - k)^2 + h} \tag{2}$$

$$\chi_2 = \chi_h + \Xi \tag{3}$$

$$\Xi = \frac{y_k}{\tan^{-1}(\pi - \theta + \Phi)} \tag{4}$$

$$\Phi = \tan^{-1}\left(\frac{y_k - k}{x_h - h}\right) \tag{5}$$

$$\theta = \Phi - \gamma \tag{6}$$

$$\gamma = \tan^{-1}\left(\frac{y_k}{x_h}\right) \tag{7}$$

Referring to equations (2)-(7) and FIG. 2, the parameters that may be tuned are defined by x-y coordinates that originate at primer explosion shockwaves origin 38' and include the following: location point (h, k) of center 80; radius R of circular arc 78; a major inner diameter ($k_3$); and a diameter ($k_2$); or caliber, of neck portion 58. The output parameter is $x_2$, which is the location ($x_2$, 0) at which redirected primer explosion shockwaves 36' intersect center longitudinal axis 70 of shellcase body 50. The points along semi-circular sidewall 72 are located at ($x_h$, $y_k$) and are bounded by $k_2$ and $k_3$.

Figure 4:
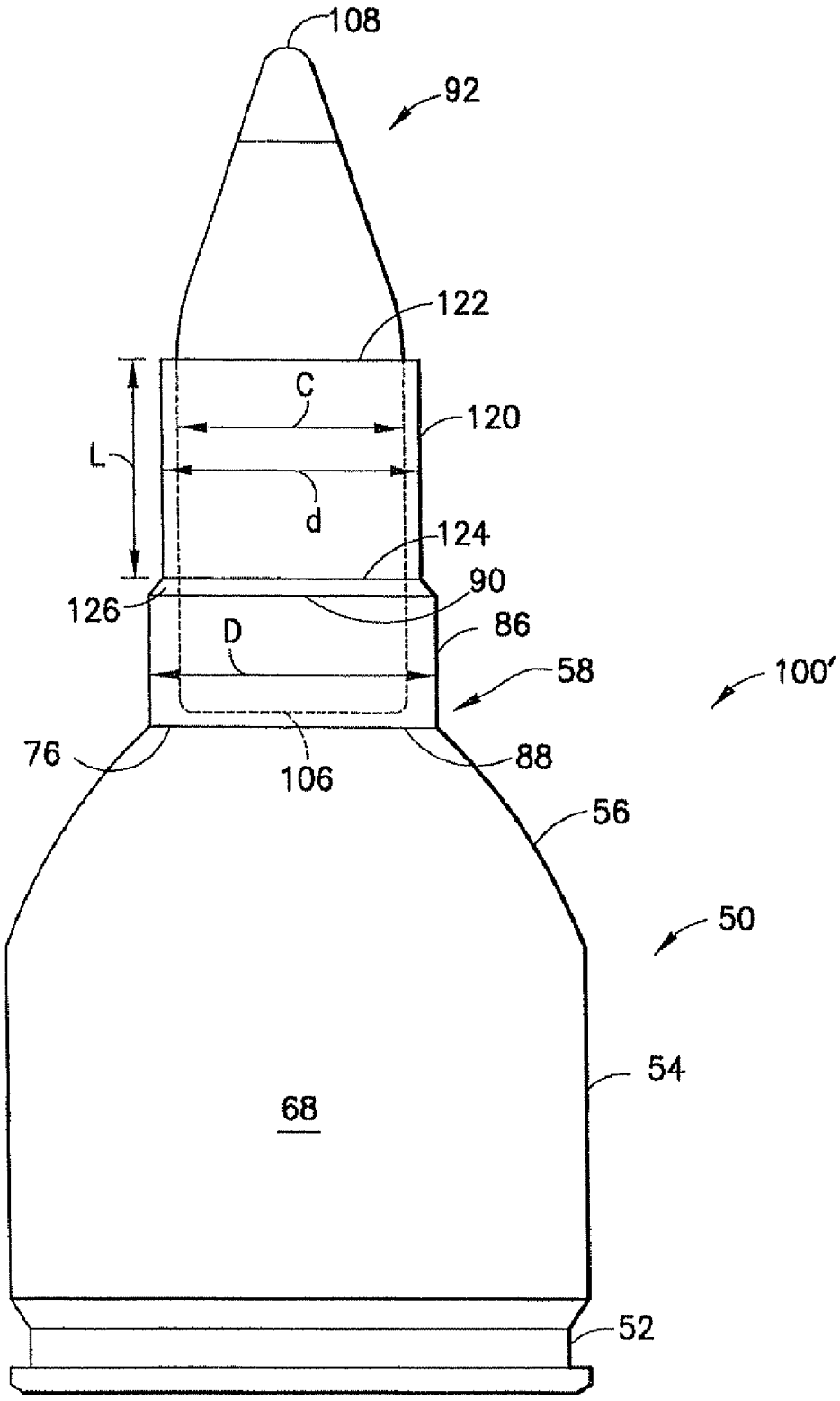
FIG. 4 is a front elevation view of an ammunition cartridge according to one embodiment of the present invention.

Referring now to FIG. 3, another embodiment of the present invention is an ammunition cartridge 100 including shellcase body 50. Ammunition cartridge 100 includes a primer 102 positioned within center boring 60 of annular base portion 52, a propellant 104 positioned within internal cavity 68 of substantially cylindrical middle portion 54, and projectile 92 having fore and aft portions 106 and 108, respectively. Projectile 92 is of a predetermined caliber. Typically, at least a portion, e.g., aft portion 106, of projectile 92 is positioned in and retained by substantially cylindrical neck portion 58. As illustrated in FIG. 4 and discussed further below, substantially cylindrical neck portion 58 typically has a diameter that is approximately the same as the caliber of projectile 92 so that the projectile fits with some interference within the neck portion. In one embodiment, cylindrical neck portion 58 has a length that is also approximately the same as the caliber of the projectile. In addition, aft portion 106 is typically positioned adjacent aft end 88 of substantially cylindrical neck portion 58 with fore portion 108 extending from the substantially cylindrical neck portion.

Considering the geometry of inner cavity 68, it is preferred that projectile 92 not protrude into the cavity. Protrusion would likely cause decreased powder capacity and also disruption of the redirection of primer explosion shockwaves 36' (see FIG. 2). Thus, aft portion 106 of projectile 92 is typically positioned at or very near the interface between fore end 76 of shoulder portion 56 and aft end 88 of neck portion 58. At the same time, neck portion 58 is generally sized so as to have a sufficient length to properly hold projectile 92.

Figure 5:
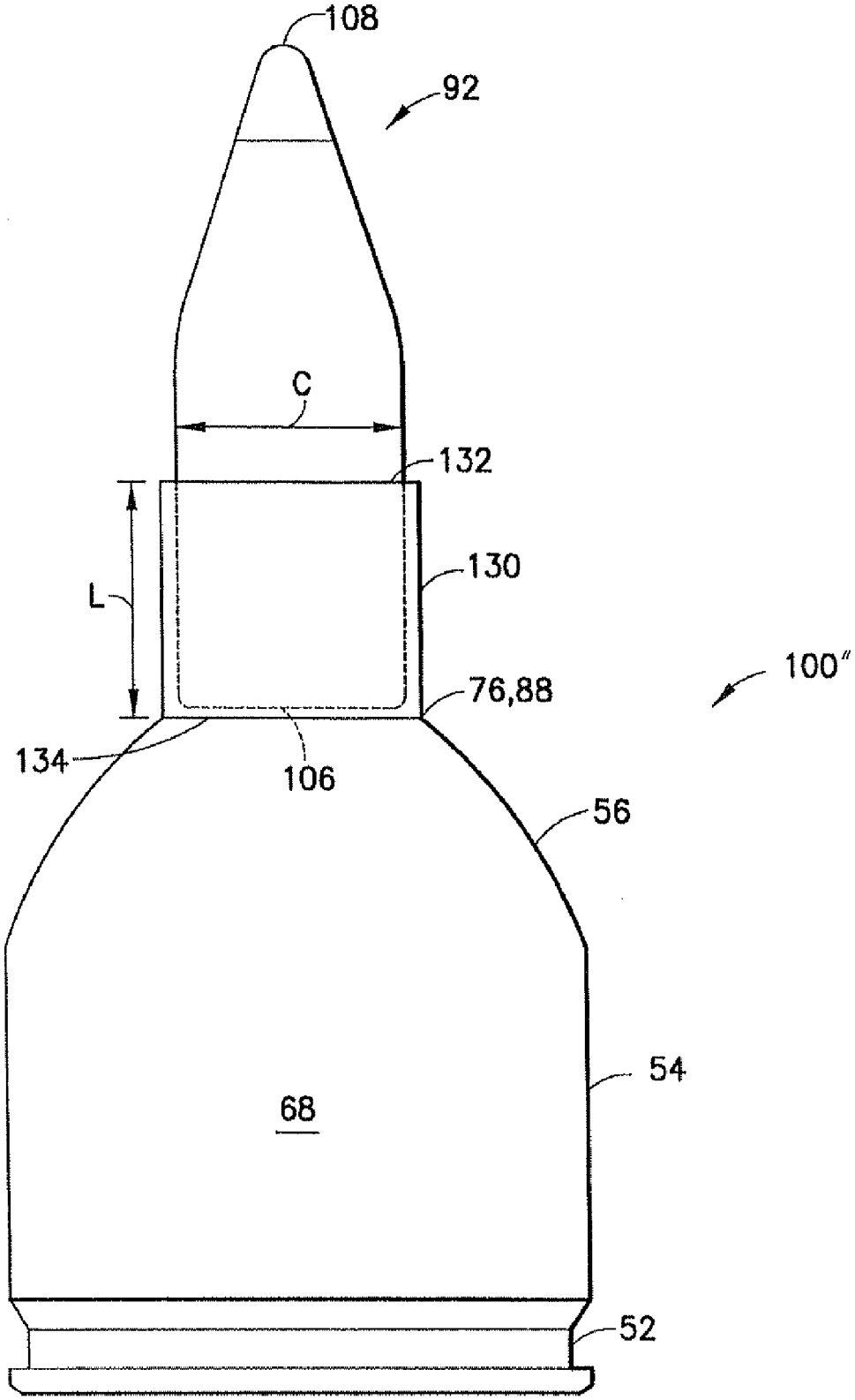
FIG. 5 is a front elevation view of an ammunition cartridge according to one embodiment of the present invention.

Referring now to FIGS. 4 and 5, in other embodiments of the present invention, ammunition cartridges 100' and 100" are designed so that a specific length of the shellcase is engaged with projectile 92. Because there are myriad bullet types in the same caliber and more specifically myriad bullet aft portion or heel types, e.g., boattails, etc., it may be necessary to design the shellcase and neck so that all bullets interface with the shellcase and shellcase neck a similar amount. In addition, elongation of the shellcase neck may provide a shellcase headspace location to help facilitate proper chambering of the shellcase in a firearm.

In FIG. 4, an ammunition cartridge 100' includes an elongated portion 120 joined with neck portion 58 of shellcase body 50 thereby developing a "double neck." Elongated portion 120 includes fore and aft ends 122 and 124, respectively. Aft end 124 is typically joined to fore end 90 of neck portion 58 via a frusto-conical portion 126. Frusto-conical portion 126 may facilitate location of cartridge 100' within a firearm chamber (not shown). Typically, elongated portion 120 has a smaller inner diameter d than diameter D of neck portion 58. Smaller inner diameter d is generally sized to encircle and engage projectile 92, i.e., approximately the same as a predetermined caliber C of the projectile. In contrast, diameter D of neck portion 58 is such that projectile 92 does not contact the neck portion. As also discussed further below, neck portion 58 is sized so as to maintain the proper shellcase internal cavity surface area and volume. In addition, elongated portion 120 generally has a length L equal to predetermined caliber C. Elongated portion 120 is typically located at such a distance to clear all projectile 92 heel orientations and engage the projectile on its bearing surface (not shown). Projectile 92 is typically sized and positioned within neck portion 58 and elongated portion 120 so that aft portion 106 terminates adjacent the junction of aft end 88 and fore end 76.

Referring now to FIG. 5, in another embodiment, an ammunition cartridge 100" includes an elongated portion 130, which has a fore end 132 and an aft end 134. Aft end 134 is joined with fore end 76 of shoulder portion 56. Ammunition cartridge 100" differs from ammunition cartridge 100' in that instead of having a neck portion 58 and an elongated portion 120, only an elongated portion 130 is included. Elongated portion 130 generally has a length L equal to predetermined caliber C of projectile 92. Similar to ammunition cartridge 100', projectile 92 is typically sized and positioned within elongated portion 130 so that aft portion 106 terminates adjacent the junction of aft end 88 and fore end 76.

Another embodiment of the invention is a method of controlling shockwaves from an explosion of a primer in an ammunition cartridge. The first step of the method includes forming a shellcase having a center longitudinal axis and including both a substantially straight sidewall and a semi-circular sidewall. The semi-circular sidewall has a curvature that is defined by a circular arc having a predetermined radius and a center that is positioned a distance away from of the center longitudinal axis. The semi-circular sidewall is joined with the substantially straight sidewall at a secant point of the circular arc. For example, if the semi-circular sidewall is laid over the circular arc, the substantially straight sidewall intersects the circular arc at two points, with one of the two points being the secant point at which the semi-circular sidewall and substantially straight sidewall are joined. The next step of the method involves directing the primer explosion shockwaves at the semi-circular sidewall. In this way, the primer explosion shockwaves reflect off of the semi-circular sidewall to form a fan-like array. The method may also include a step of creating an interface between the semi-circular sidewall and a neck portion, with the neck portion being pressure fit around a projectile. The projectile has one end that is adjacent to the interface and the predetermined radius is selected so that the fan-like array is positioned adjacent the one end.

Figure 6:
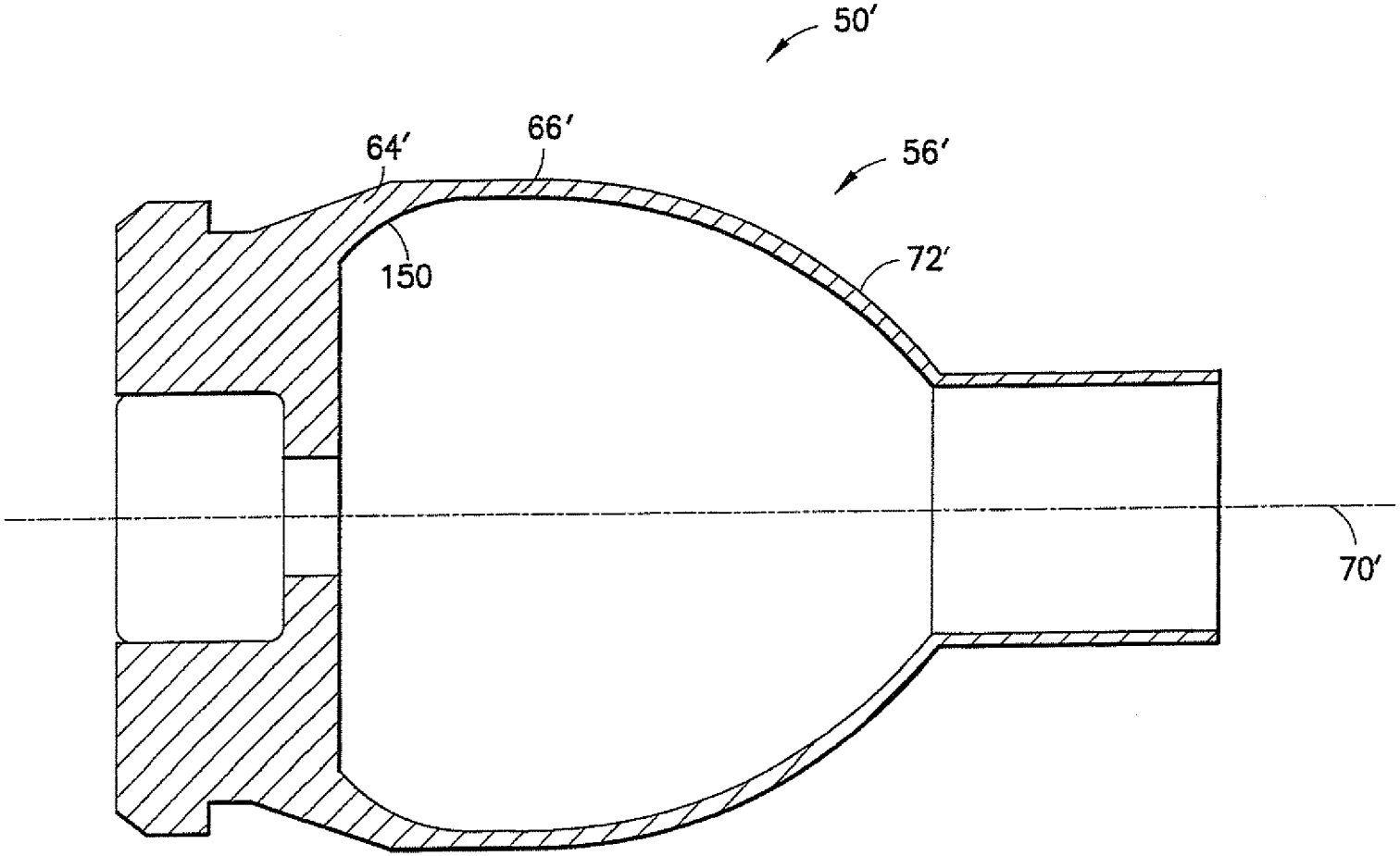
FIG. 6 is a cross-section of a shellcase body according to one embodiment of the present invention.

Referring now to FIG. 6, in an alternative embodiment of the present invention, shellcase body 50' includes a tapered sidewall 150 having a fore end 66' and an aft end 64'. Fore end 66' joined with a semi-circular sidewall 72' of an annular shoulder portion 56'. Tapered sidewall 150 is typically a circular arc whose center is positioned off of a center longitudinal axis 70' of shellcase body 50'. Accordingly, tapered sidewall 150 may be configured similarly to substantially straight sidewall 62 to control the direction of any shockwaves (not shown) that reflect off of the tapered sidewall.

Figure 7:
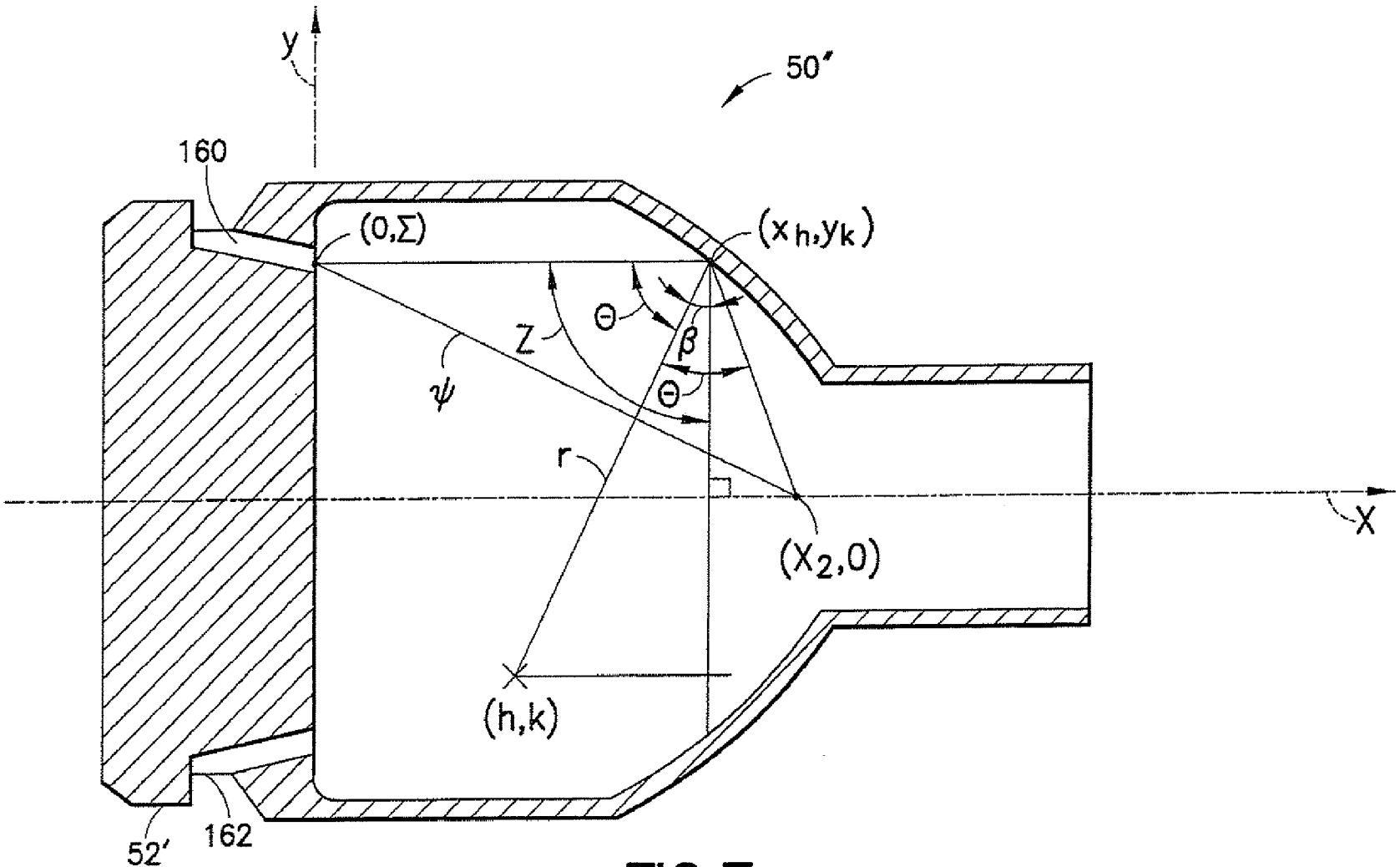
FIG. 7 is a cross-section of a shellcase body according to one embodiment of the present invention.

Referring now to FIG. 7, in another alternative embodiment of the present invention, shellcase body 50" includes a groove 160 to allow for rimfire, i.e. primer shockwave origin along outside edge 162 of annular base portion 52'. With the exception of a rimfire design, shellcase body 50" is identical in all other aspects to shellcase body 50. For shellcase body 50", equations (2)-(5) may still be used to tune the redirection of primer shockwaves. However, equations (6) and (7) are replaced with equations (8) through (11) as follows:

$$\Psi = \sqrt{\chi_h^2 - (\Sigma - y_k)^2 + y_k^2} \tag{8}$$

$$Z = \cos^{-1}\left(\frac{\Psi - \chi_h^2 - (\Sigma - y_k)^2 + y_k^2}{2y_k\left(\sqrt{\chi_h^2 + (\Sigma - y_k)^2}\right)}\right) \tag{9}$$

$$\theta = Z - \beta \tag{10}$$

$$\beta = \tan^{-1}\left(\frac{y_k + k}{x_h - h}\right) \tag{11}$$

As follows, equations (8), (9) and (11) are solved. Then equation (10) is solved. From there, $x_2$ may be solved to determine the location of a shockwave's intersection with the x-axis.

In use, shellcase body 50 and ammunition cartridges 100, 100', and 100", are designed to control the reflection of primer explosion shockwaves 36' (see FIG. 2) to form a fan-like array 140 of shockwaves at a shockwave area 40'. Fan-like array 140 concentrates a large portion of the redirected primer explosion shockwaves 36 and shockwave area 40' is typically located just behind aft portion 106 of projectile 92. A primer flame front (not shown) generally ignites the majority of propellant 104. Fan-like array 140, which defines a concentration of primer explosion shockwaves 36', heats and ignites the portion of propellant 104 not ignited by the flame front.

Defining the shellcase shoulder sidewall to have a semi-circular curvature offers advantages over previous designs. Semi-circular sidewalls are more easily manufactured or machined over other types of curves, e.g., ellipses, parabolas, etc. In addition, the shellcase shoulder of the present invention may improve on shellcase propellant burning efficiency thereby leaving very little unburned propellant to follow the projectile down the barrel bore. In addition, aspects of the shellcase shoulder of the present invention may improve the aesthetics of the ammunition cartridge overall.

As mentioned above, the semi-circular sidewall will not redirect the primer explosion shockwave to a single point within the shellcase's internal cavity. Rather, it will direct the shockwaves to a fan-like array. Fan-like arrays offer benefits over prior art designs in that they may be tuned so as to concentrate the majority of the redirected explosion to a desired focus area. Such tuning may be accomplished by varying the degree of non-tangency, or secancy, of the junction between the shoulder semi-circular and straight sidewalls. The radius of the circular arc defining the curvature of the semi-circular sidewall may also modify the shockwave redirecting tendencies of the internal cavity. Changes in the projectile diameter, or caliber, may also add to the tuning capability of the focus area.

The embodiments illustrated in FIGS. 4 and 5 offer advantages over prior art designs. Placing a headspacing surface near the point of projectile-to-shellcase engagement increases the likelihood that all projectiles fired from the same chamber will be held in the same location with respect to the rifle bore before firing. This will increase the accuracy potential of the cartridge.

Although the invention has been described and illustrated with respect to exemplary embodiments thereof, it should be understood by those skilled in the art that the foregoing and various other changes, omissions and additions may be made therein and thereto, without parting from the spirit and scope of the present invention.

What is claimed is:

1. A shellcase body for use as part of an ammunition cartridge, comprising: a base portion; a middle portion joined with said base portion, said base portion and said middle portion being arranged around a center longitudinal axis; and a shoulder portion having a curvature that is defined by a circle having a predetermined radius and a center that is positioned a distance away from said center longitudinal axis, wherein said shoulder portion is joined with said middle portion at a secant point of said circle, and a neck portion joined with said shoulder portion at an end opposite said secant point, and an elongated portion joined with said neck portion via a frusto-conical portion.

2. A body according to claim 1, wherein said elongated portion has a smaller inner diameter than said neck portion.

3. A body according to claim 2, wherein said smaller inner diameter of said elongated portion is sized to encircle a projectile of a predetermined caliber and have a length equal to said predetermined caliber.

4. A shellcase body for use as part of an ammunition cartridge, comprising: an annular base portion having a center boring formed therethrough; a substantially cylindrical middle portion having a substantially straight sidewall including an aft end and a fore end, said aft end being joined with said annular base portion, said annular base portion and said substantially cylindrical middle portion being arranged around a center longitudinal axis; an annular shoulder portion having a semi-circular sidewall that extends between an aft end and a fore end, said semi-circular sidewall having a curvature that is defined by a circle having a predetermined radius and a center that is positioned a distance away from said center longitudinal axis, wherein said aft end is joined with said fore end of said substantially straight sidewall at a secant point of said circle; and a substantially cylindrical neck portion having a substantially straight sidewall including an aft end and a fore end, said aft end being joined with said fore end of said semi-circular sidewall, and an elongated substantially cylindrical portion defined by fore and aft ends, said aft end being joined with said fore end of said substantially cylindrical neck portion via a frusto-conical portion.

5. A body according to claim 4, wherein said elongated substantially cylindrical portion has a smaller inner diameter than said substantially cylindrical neck portion.

6. A body according to claim 5, wherein said smaller inner diameter of said elongated substantially cylindrical portion is sized to encircle a projectile of a predetermined caliber and have a length equal to said predetermined caliber.

7. An ammunition cartridge, comprising: a shellcase body including: an annular base portion having a center boring formed therethrough; a substantially cylindrical middle portion having a substantially straight sidewall including an aft end and a fore end, said aft end being joined with said annular base portion, said annular base portion and said substantially cylindrical middle portion being arranged around a center longitudinal axis, said substantially cylindrical middle portion having an internal cavity in communication with said annular base portion; an annular shoulder portion having a semi-circular sidewall that extends between an aft end and a fore end, said semi-circular sidewall having a curvature that is defined by a circle having a predetermined radius and a center that is positioned a distance away from said center longitudinal axis, wherein said aft end is joined with said fore end of said substantially straight sidewall at a secant point of said circle; and a substantially cylindrical neck portion having a substantially straight sidewall including an aft end and a fore end, said aft end being joined with said fore end of said semi-circular sidewall; a primer positioned within said center boring of said annular base portion; a propellant positioned within said internal cavity of said substantially cylindrical middle portion; a projectile having fore and aft portions, at least a portion of said projectile positioned in and retained by said substantially cylindrical neck portion, said aft portion positioned adjacent said aft end of said substantially cylindrical neck portion and said fore portion extending from said substantially cylindrical neck portion, and an elongated substantially cylindrical portion defined by fore and aft ends, said aft end being joined with said fore end of said substantially cylindrical neck portion via a frusto-conical portion.

8. A cartridge according to claim 7, wherein said elongated substantially cylindrical portion has a smaller inner diameter than said substantially cylindrical neck portion.

9. A cartridge according to claim 7, wherein said projectile has a predetermined caliber, said smaller inner diameter of said elongated substantially cylindrical portion is sized to pressure fit and retain said projectile, and said elongated substantially cylindrical portion has a length equal to said predetermined caliber.

10. A method of controlling shockwaves from an explosion of a primer in an ammunition cartridge, comprising the steps of:

forming a shellcase having a center longitudinal axis and including both a substantially straight sidewall and a semi-circular sidewall having a curvature that is defined by a circle having a predetermined radius and a center that is positioned a distance away from of said center longitudinal axis, wherein said semi-circular sidewall is joined with said substantially straight sidewall at a secant point of said circle; and directing said primer explosion shockwaves at said semi-circular sidewall.

11. A method according to claim 10, wherein said primer explosion shockwaves reflect off of said semi-circular sidewall to form a fan-like array.

12. A method according to claim 11, further comprising the step of:

creating an interface between said semi-circular sidewall and a neck portion, said neck portion being pressure fit around a projectile, said projectile having one end that is adjacent to said interface, wherein said predetermined radius is selected so that said fan-like array is positioned adjacent said one end of said projectile adjacent to said interface.

13. A system for controlling shockwaves from an explosion of a primer in an ammunition cartridge, comprising:

means for forming a shellcase having a center longitudinal axis and including both a substantially straight sidewall and a semi-circular sidewall having a curvature that is defined by a circle having a predetermined radius and a center that is positioned a distance away from said center longitudinal axis, wherein said semi-circular sidewall is joined with said substantially straight sidewall at a secant point of said circle; and means for directing said primer explosion shockwaves at said semi-circular sidewall.

14. A system according to claim 13, wherein said primer explosion shockwaves reflect off of said semi-circular sidewall to form a fan-like array.

15. A system according to claim 14, further comprising:

means for creating an interface between said semi-circular sidewall and a neck portion, said neck portion being pressure fit around a projectile, said projectile having one end that is adjacent to said interface;

wherein said predetermined radius is selected so that said fan-like array is positioned adjacent said one end of said projectile adjacent to said interface.

* * * * *